US009776190B2

(12) United States Patent
Moszumański et al.

(10) Patent No.: US 9,776,190 B2
(45) Date of Patent: Oct. 3, 2017

(54) DRIVE FOR AN ULTRA-HIGH-ENERGY PULSATORY-ROTARY MILL

(71) Applicants: Ryszard Moszumański, Kraków (PL); SŁ awomir Knapik, Wola Filipowska (PL); Jerzy Kryza, Kraków (PL); Maciej Moszumański, Kraków (PL); Krystyna Wieczorek Ciurowa, Kraków (PL)

(72) Inventors: Ryszard Moszumański, Kraków (PL); SŁ awomir Knapik, Wola Filipowska (PL); Jerzy Kryza, Kraków (PL); Maciej Moszumański, Kraków (PL); Krystyna Wieczorek Ciurowa, Kraków (PL)

(73) Assignee: POLITECHNIKA KRAKOWSKA IM. TADEUSZA KOCIUSZKI, Cracow (PL)

( * ) Notice: Subject to any disclaimer, the term of this patent is extended or adjusted under 35 U.S.C. 154(b) by 514 days.

(21) Appl. No.: 14/334,409

(22) Filed: Jul. 17, 2014

(65) Prior Publication Data

US 2015/0165443 A1 Jun. 18, 2015

(30) Foreign Application Priority Data

Dec. 16, 2013 (PL) ..... 406540

(51) Int. Cl.
*B02C 17/24* (2006.01)
*B02C 17/08* (2006.01)
*B02C 17/14* (2006.01)

(52) U.S. Cl.
CPC ..... *B02C 17/24* (2013.01); *B02C 17/08* (2013.01); *B02C 17/14* (2013.01)

(58) Field of Classification Search
CPC ..... B02C 17/14; B02C 17/24; B02C 17/08
USPC ..... 241/175
See application file for complete search history.

(56) References Cited

U.S. PATENT DOCUMENTS 2,650,033 A * 8/1953 Ahlmann ..... B02C 17/14 241/175
3,308,657 A * 3/1967 Kus ..... F16C 13/04 241/101.2
3,679,033 A * 7/1972 Wagner ..... F16D 25/14 192/114 R
6,036,126 A * 3/2000 Cappola ..... B07B 1/28 209/315

(Continued)

*Primary Examiner* — Mark Rosenbaum
(74) *Attorney, Agent, or Firm* — Horst M. Kasper

(57) ABSTRACT

The subject of the invention is a drive for an ultra-high-energy pulsatory-rotary mill that can be applied in the laboratory-class equipment.

The objective of the invention is the use of the drive for an ultra-high-energy pulsatory-rotary mill which allows to accomplish the three-dimensional milling process in three axes with simultaneous control of amount of the supplied mechanical energy in real time.

The rotary-planetary drive comprises an alternating-current motor (1) constituting the rotary motion drive and powered through an inverter (2) connected with the rotary mechanical energy counter (3), and an alternating-current motor (4) driving actuator (5) constituting the pulsatory motion drive and powered by inverter (6) connected with the pulsatory mechanical energy counter (7). Signals from mechanical energy counters (7) and (3) are conveyed to the digital recorder (8).

6 Claims, 4 Drawing Sheets

(56) References Cited

U.S. PATENT DOCUMENTS

| | | | | |
|---|---|---|---|---|
| 2006/0207370 | A1* | 9/2006 | Hedman | F16H 57/0482 74/468 |
| 2013/0017924 | A1* | 1/2013 | Shimizu | F16H 1/46 475/337 |
| 2013/0109529 | A1* | 5/2013 | Maehata | F16H 1/2818 475/345 |
| 2014/0056618 | A1* | 2/2014 | Matsuda | G03G 15/757 399/167 |
| 2015/0201560 | A1* | 7/2015 | Demirdzhi | A01D 69/005 460/116 |

* cited by examiner

DRIVE FOR AN ULTRA-HIGH-ENERGY PULSATORY-ROTARY MILL

The subject of the present invention is a drive for an ultra-high-energy pulsatory-rotary mill that can be used in laboratory-class apparatus.

Commonly known and widely used ball mills use typically driving solutions employing planetary transmission providing a drive for the sun gear and the vials with the use of a single drive motor. Solutions based on the belt transmission are also used.

Solutions used currently in ball mill drives ensure correct and stable drive for the sun gear and vials in a single plane.

It is not possible to drive milling media in the third axis which would be necessary for carrying out an active three-dimensional milling process.

The objective of the present invention is application of a drive for an ultra-high-energy pulsatory-rotary mill allowing the three-dimensional milling process to be carried out in three axes with simultaneous control of the amount of supplied energy in real time.

The essential idea behind the proposed ultra-high-energy pulsatory-rotary mill drive consists in superposition of two drive types, namely the rotary-planetary drive system and the pulsatory drive system.

A shaft constitutes the rotation axis for the rotary-planetary drive system and at the same time it serves as a means for connection of the pulsatory drive. The shaft is also equipped with a vibro-insulator protecting the pulsatory drive against harmful effects of pulsation. Further, the amount of the supplied mechanical energy is also counted in real time independently for the rotary-planetary drive and the pulsatory drive.

The pulsatory drive comprises a vibration actuator (5) located on the pressure table (17) mounted slidably on the shaft (IS) and connected with an assembly of the mill pots (15) by means of an upper slide sleeve (19) and a lower slide sleeve (20). The slide sleeves (19) and (20) are protected against rotation with respect to the shaft (IS) by means of a key slot (21). The assembly of the mill pots (15) comprises the pots (22) mounted between the lower rotary cage (23) constituting a mounting for vibro-insulator (24) and an elevated upper cage (25) protected against opening in the course of operation of the mill by means of ties (26).

An example embodiment of the invention is shown in FIG. 1, FIG. 2, and FIG. 3.

Figure 1:
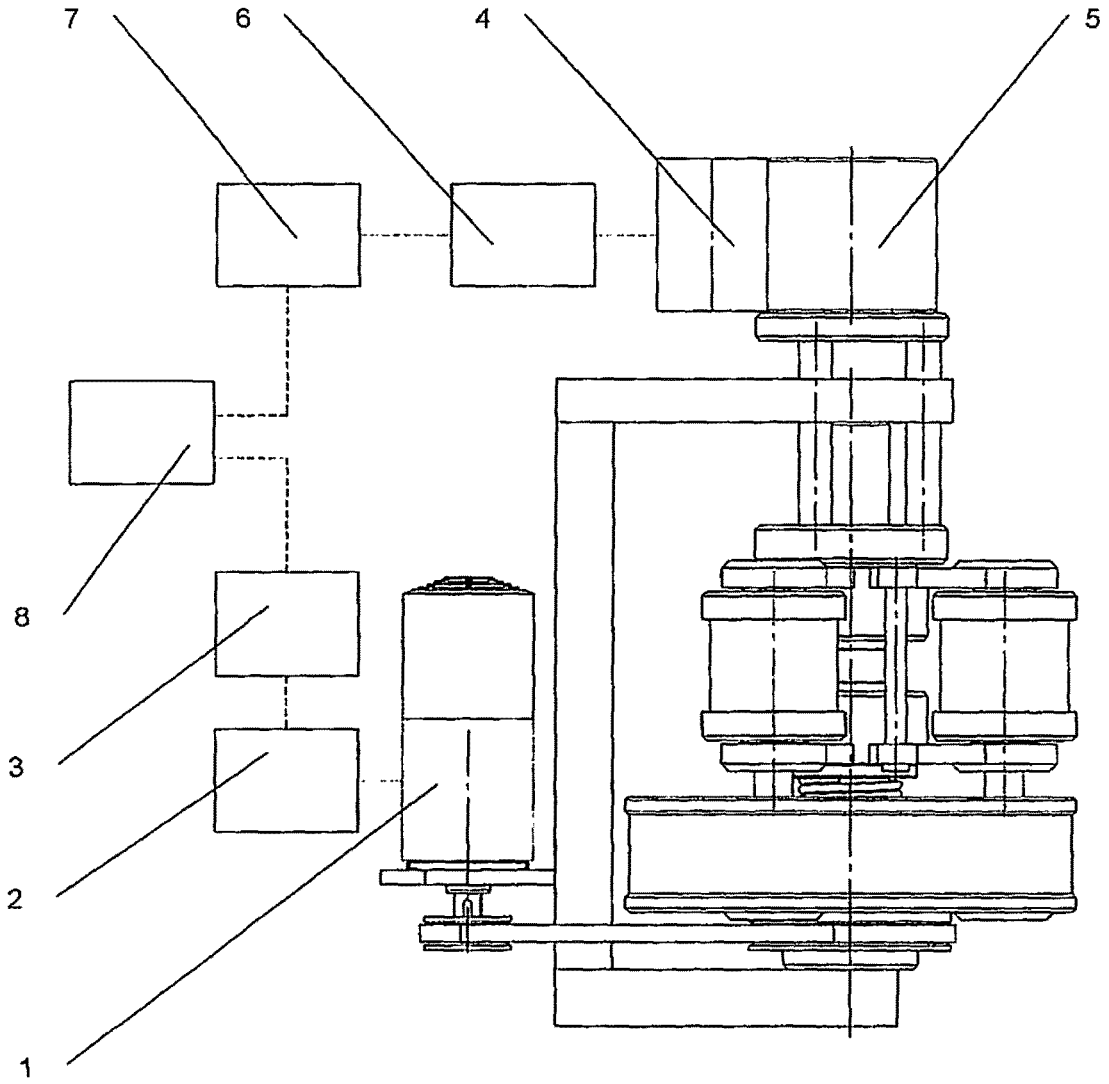
FIG. 1 shows a block diagram of the ultra-high-energy pulsatory-rotary mill.
Figure 2:
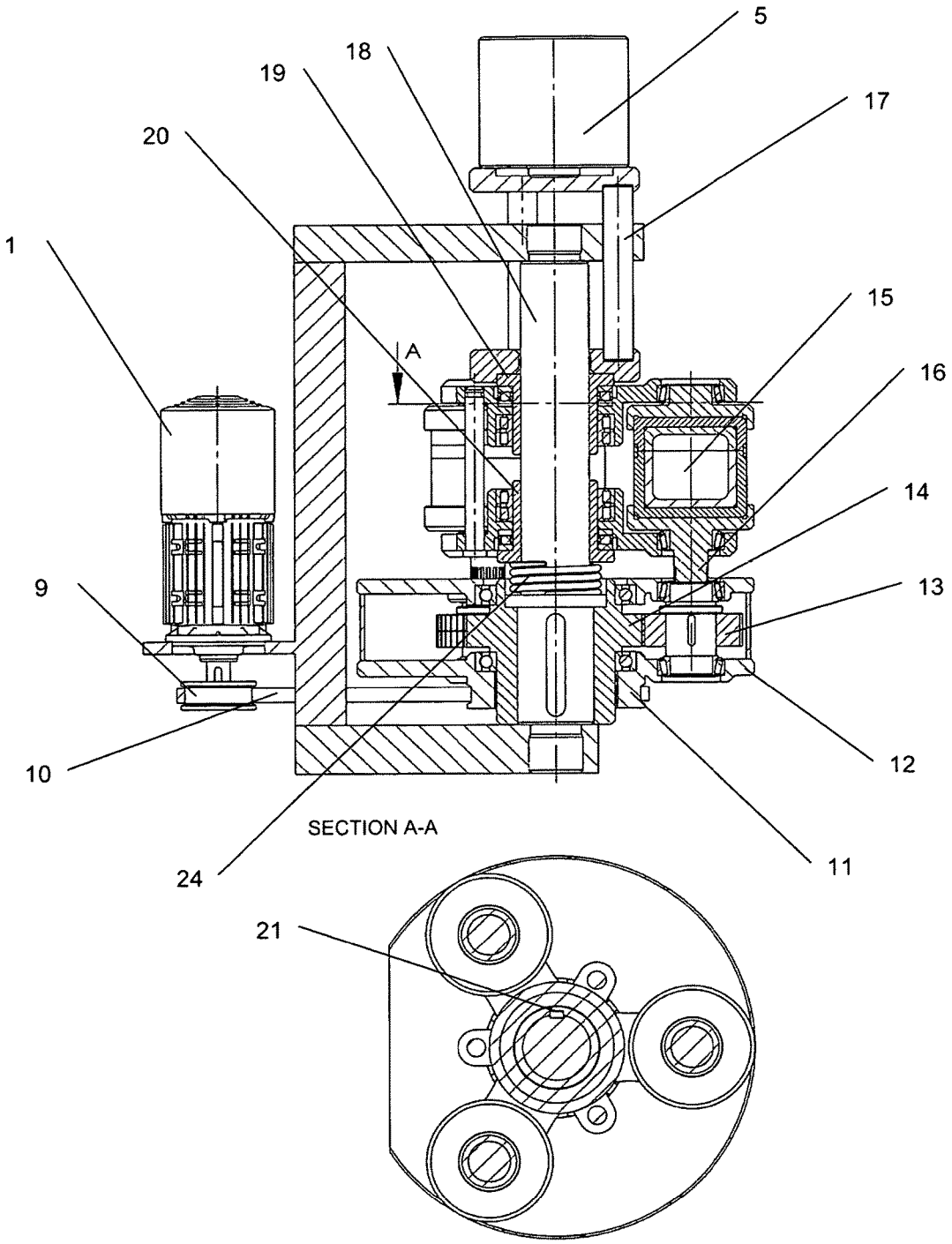
FIG. 2 shows the sectional view A-A of the ultra-high-energy pulsatory-rotary mill.
Figure 3:
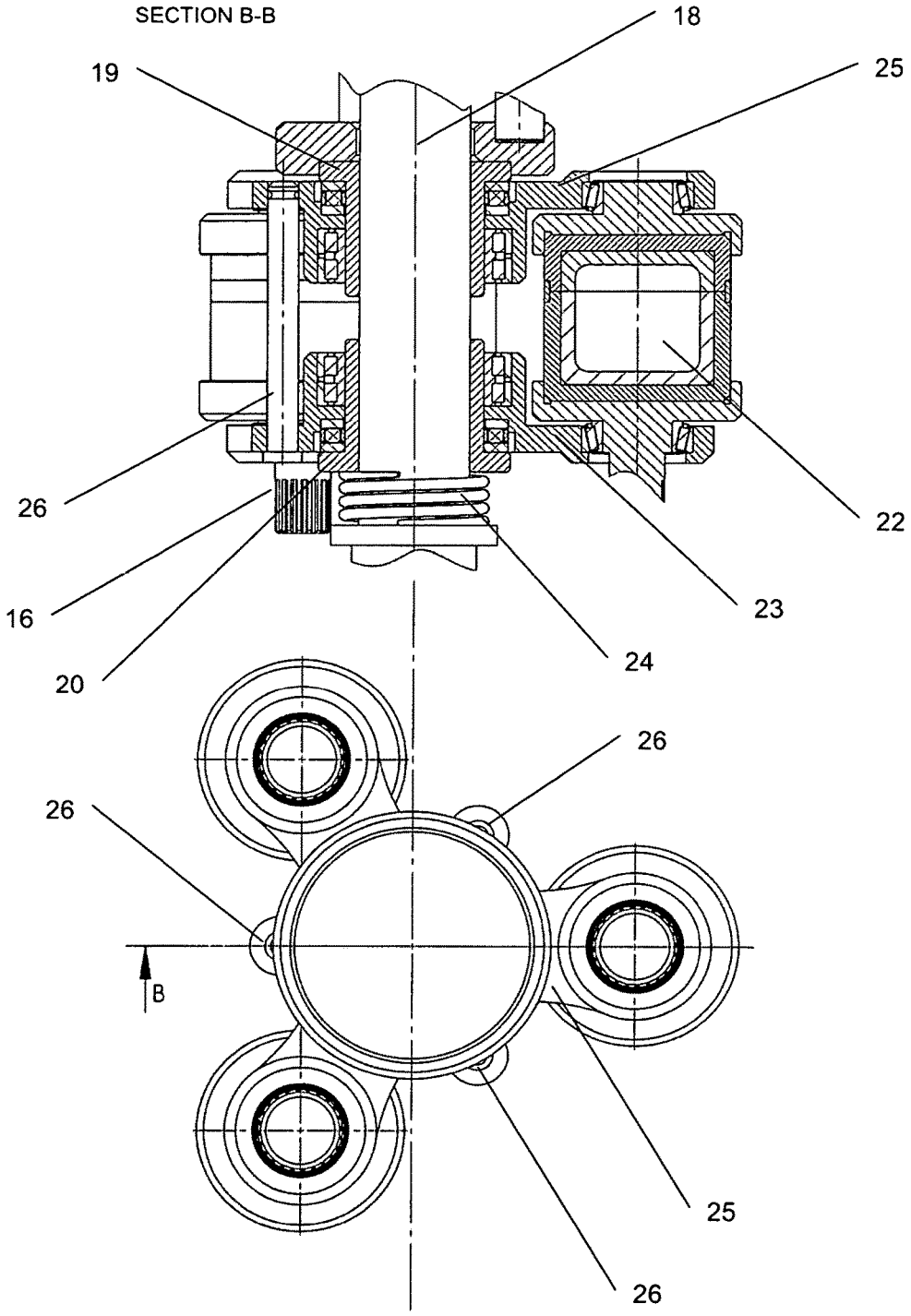
FIG. 3 shows the sectional view B-B of the ultra-high-energy pulsatory-rotary mill.

The rotary-planetary drive comprises an alternating-current motor (1) constituting the rotary drive powered through an inverter (2) and connected with the rotary mechanical energy counter (3), an alternating-current motor (4) driving actuator (5) constituting the pulsatory motion drive, powered through an inverter (6) connected to the pulsatory mechanical energy counter (7). Signals from mechanical energy counters (7) and (3) are conveyed to a digital recorder (8).

A belt pulley (9) mounted on the motor shaft (1) drives a belt pulley (11) secured to the transmission cage (12) by means of a driving belt (10). Planetary gears (13) mounted in the cage revolve about the stationary sun gear (14). The driving torque from planetary gears (13) is transferred onto the assembly of vials (15) by means of a sliding spline joint (16) thus allowing a combination of planetary and pulsatory motion.

Figure 4:
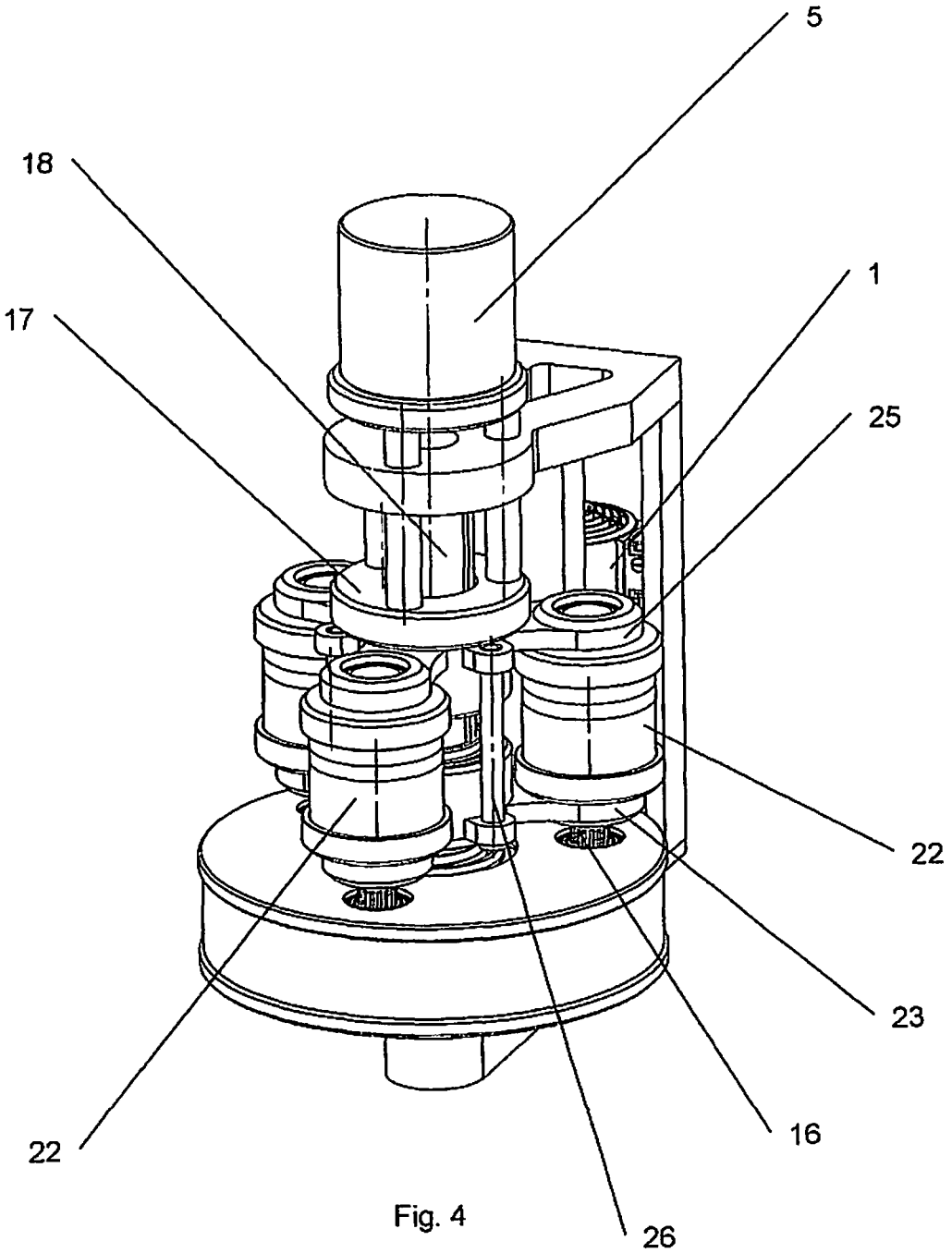
FIG. 4 shows an example of application of the ultra-high-energy pulsatory-rotary.

An example of application of the ultra-high-energy pulsatory-rotary mill drive in a complete pulsatory-rotary mill is shown in FIG. 4.

The ultra-high-energy pulsatory-rotary mill drive will find its application in industrial and research laboratories.

The build-in function of counting the amount of the supplied mechanical energy in real time independently for the rotary-planetary drive and the pulsatory drive will find its application in the complete pulsatory-rotary mill energy balancing process.

The invention claimed is:

1. A drive for an ultra-high-energy pulsatory-rotary mill characterised in that it has the functionality of superposition of two drive types, a rotary drive and a pulsatory drive, accomplished by transferring the torque from planetary gears (13) onto an assembly of vials (15) via a sliding spline joint (16).

2. A drive for an ultra-high-energy pulsatory-rotary mill according to claim 1 characterised in that the pulsatory drive comprises a vibration actuator (5) located on a pressure table (17) mounted slidably on a shaft (18) and connected with the assembly of vials (15) by means of an upper slide sleeve (19) and a lower slide sleeve (20), while the slide sleeves (19) and (20) are protected against rotation with respect to the shaft (18) by means of a key slot (21), whereas the assembly of vials (15) comprises vials (22) mounted between a lower rotary cage (23) constituting a mounting for a vibro-insulator (24) and an elevated upper cage (25) protected against opening in the course of operation of the mill by means of ties (26).

3. A drive for an ultra-high-energy pulsatory-rotary mill according to claim 1 characterised in that the amount of mechanical energy supplied by the drive is counted and recorded in real time independently for the rotary-planetary drive and the pulsatory drive, whereas the functionality is realized by means of conveying respective signals from an inverter (2) to a mechanical rotational energy counter (3), transmitting respective signals from an inverter (6) to a mechanical pulsatory energy counter (7), and leading output signals from the mechanical rotary energy counter (3) and the mechanical pulsatory energy counter (7) to input terminals of a digital recorder (8).

4. A drive for an ultra-high-energy pulsatory-rotary ball mill comprising a driving motor for driving a sun gear for simultaneous transmission of a rotary driving and a planetary driving to an assembly of mill pots wherein a pulsatory drive of the assembly of the mill pots is superposed with a rotary drive of the latter and a shaft constitutes a rotation axis for the rotary drive and simultaneously constitutes a transfer means for the pulsatory drive while the torque from planetary gears is transferred onto an assembly of the mill pots via a sliding spline joint.

5. The drive according to claim 4 wherein the pulsatory drive comprises a vibration actuator located on a pressure table mounted slidably on the shaft and connected with the assembly of the mill pots by means of an upper slide sleeve and a lower slide sleeve, while the said slide sleeves are protected against rotation with respect to the shaft by means of a key slot, whereas the assembly of the mill pots comprises the pots mounted between a lower rotary cage constituting a mounting for vibro-insulator and an elevated upper cage protected against opening in the course of operation of the mill by means of ties.

6. The drive according to claim 4, wherein an amount of mechanical energy supplied by the drive is counted and recorded in real time independently for the rotary-planetary drive and the pulsatory drive, whereas this functionality is realized by means of conveying respective signals from an inverter to a mechanical rotational energy counter, transmitting respective signals from a second inverter to a mechanical pulsatory energy counter, and leading output signals from the mechanical rotary energy counter and the mechanical pulsatory energy counter to an input terminals of a digital recorder.

* * * * *